US007623416B2

(12) United States Patent
Ebi

(10) Patent No.: US 7,623,416 B2
(45) Date of Patent: Nov. 24, 2009

(54) BATTERY ELECTRODE TERMINAL MEMBER AND ELECTRONIC TIMEPIECE POSSESSING THE SAME

(75) Inventor: Akira Ebi, Chiba (JP)

(73) Assignee: Seiko Instruments Inc. (JP)

( * ) Notice: Subject to any disclaimer, the term of this patent is extended or adjusted under 35 U.S.C. 154(b) by 37 days.

(21) Appl. No.: 11/318,671

(22) Filed: Dec. 27, 2005

(65) Prior Publication Data

US 2006/0140060 A1 Jun. 29, 2006

(30) Foreign Application Priority Data

Dec. 28, 2004 (JP) ..... 2004-380859

(51) Int. Cl.
*G04B 3/00* (2006.01)

(52) U.S. Cl. ..... 368/204; 368/203

(58) Field of Classification Search ..... 368/203–204, 368/88; 429/96–100

See application file for complete search history.

(56) References Cited

U.S. PATENT DOCUMENTS

| | | | | | |
|---|---|---|---|---|---|
| 4,086,753 | A * | 5/1978 | Tsuchiya et al. | ..... | 368/156 |
| 4,276,634 | A | 6/1981 | Assmus et al. | ..... | 368/300 |
| 4,392,748 | A | 7/1983 | Yoshino | ..... | 368/88 |
| 4,416,550 | A * | 11/1983 | Wolber et al. | ..... | 368/88 |
| 4,435,088 | A * | 3/1984 | Dorfman | ..... | 368/88 |
| 4,444,513 | A * | 4/1984 | Proellochs et al. | ..... | 368/223 |
| 4,496,426 | A * | 1/1985 | Baumeister et al. | ..... | 162/19 |
| 4,862,432 | A * | 8/1989 | Hiraga et al. | ..... | 368/88 |
| 4,939,707 | A * | 7/1990 | Nagao | ..... | 368/64 |
| 5,416,752 | A * | 5/1995 | Ikegami | ..... | 368/88 |
| 5,446,703 | A * | 8/1995 | Schwartz | ..... | 368/80 |
| 5,712,831 | A * | 1/1998 | Ikegami | ..... | 368/88 |
| 6,901,033 | B2 * | 5/2005 | Ito | ..... | 368/204 |
| 2002/0167868 | A1 * | 11/2002 | Murai | ..... | 368/203 |
| 2003/0198142 | A1 * | 10/2003 | Yanagisawa | ..... | 368/88 |
| 2006/0140059 | A1 * | 6/2006 | Tada | ..... | 368/88 |
| 2006/0140060 | A1 * | 6/2006 | Ebi | ..... | 368/88 |
| 2006/0140061 | A1 * | 6/2006 | Haga | ..... | 368/88 |
| 2006/0140064 | A1 * | 6/2006 | Haga | ..... | 368/190 |
| 2006/0176780 | A1 * | 8/2006 | Ono | ..... | 368/319 |

FOREIGN PATENT DOCUMENTS

GB 2125584 3/1984

OTHER PUBLICATIONS

Patent Abstract of Japan, Publication No. 2000-081491, Publication Date Mar. 21, 2000.

* cited by examiner

*Primary Examiner*—Vit M. Miska
*Assistant Examiner*—Sean Kayes
(74) *Attorney, Agent, or Firm*—Adams & Wilks

(57) ABSTRACT

A battery electrode terminal member has a spring plate structure comprised of a base body part configured to be mounted to and supported by a casing of a timepiece main body in substantial perpendicular relation to a main face of the timepiece main body. A battery electrode contact terminal part of the spring plate structure extends from one end of the base body part for elastical pressure contact with a peripheral face part of an electrode of a battery.

9 Claims, 6 Drawing Sheets

BATTERY ELECTRODE TERMINAL MEMBER AND ELECTRONIC TIMEPIECE POSSESSING THE SAME

BACKGROUND OF THE INVENTION

1. Field of the Invention

The present invention relates to a battery electrode terminal member like a battery plus terminal, which is pressure-contacted to a positive electrode of a battery, and an electronic timepiece possessing the same.

2. Description of the Prior Art

In a movement of a hand system wristwatch, in order to supply an electricity from the battery to an IC (Integrated Circuit) for a timepiece, hitherto, a branch-like part has been formed in a metal plate possessing a base part extending parallel to a main face of a timepiece main body, and a base part of the branch-like part has been bent in a thickness direction of the timepiece main body to thereby extend the branch-like part under a state that its main face becomes perpendicular to the main face of the timepiece main body, thereby being elastically pushed to an electrode of the battery (JP-A-2000-81491 Gazette).

However, in the battery plus terminal like this in the form of the metal plate, in order to fix the base body part to a machine casing of the timepiece main body, there are performed a screw fastening, a caulking and a hook locking. On the occasion of this fixation, not only a comparatively large area in an extension direction of the main face of the timepiece main body is necessary in order to stably fix the base body part but also a layout of components is liable to be limited. Further, owing to such facts that not only it is bent in the thickness direction but also a tip part of the thickness direction bent portion is bent in a different direction, since there arises a necessity to bend in multistage along bending lines whose directions are different, a die is liable to become complicated as well.

The invention is one made in view of the points mentioned above, and its object is to provide a battery electrode terminal member capable of suppressing an occupation area along the main face of the timepiece main body to a size of lowest limit, and an electronic timepiece possessing the same.

SUMMARY OF THE INVENTION

In order to achieve the above object, a battery electrode terminal member of the invention comprises an elongated metal-made plate spring as a whole, and has a base body part mounted to and supported by a machine casing of a timepiece main body substantially, perpendicularly to a main face of the timepiece main body, and a battery electrode contact terminal part extended from one end of the base body part and elastically pushed to a peripheral face part of an electrode of a battery.

In the battery electrode terminal member of the invention, since the elongated metal-made plate spring as a whole possesses the base body part mounted to and supported by the machine casing of the timepiece main body substantially, perpendicularly to the main face of the timepiece main body, an area that the base body part occupies in a direction along the main face of the timepiece main body can be suppressed to a lowest limit. Further, in the battery electrode terminal member of the invention, since the elongated metal-made plate spring as a whole possesses the battery electrode contact terminal part extended from one end of the base body part and elastically pushed to the peripheral face part of the electrode of the battery, even if a bending exist it can be suppresses to the lowest limit, so that also its manufacture can be performed easily and inexpensively.

In the battery electrode terminal member of the invention, even in a case where a tip part is bent, since it suffices if one place or plural places is/are bent in the same direction or along parallel bending lines typically in an angle range of 90 degrees or less, also its manufacture can be performed easily and inexpensively.

In the battery electrode terminal member of the invention, typically, the base body part is supported while being nipped between protrusion parts or in groove parts of the machine casing of the timepiece main body. In this case, the battery electrode terminal member can be supported under a state that a region required for supporting has been made the lowest limit. The protrusion parts may be opposed so as to nip a held part of the base body part while becoming a pair, or may be zigzag provided. The protrusion parts may be formed monolithically with the machine casing itself, or may be formed with a pin and the like being implanted to a machine casing main body. It is similar about the groove parts. Here, the groove part means one in which its both side walls extend over a length more than a certain degree along a longitudinal direction of the base body part. On the other hand, the protrusion part means one supporting a corresponding face of the base body part under a state approximating to a point contact (line contact when seen in a width direction). Although a cross-sectional shape of the protrusion part is typically a triangle like a rice ball, it may be other shape such as circular shape.

Here, there may be adapted such that the base body part of a plate spring structural body is directly held while being nipped between the protrusion parts or in the groove parts of the machine casing of the timepiece main body, there may be adapted such that, by the facts that under a state that it has been nipped between the protrusion parts or in the groove parts of the machine casing of the timepiece main body it is under a loosely fitting state, and that the battery electrode contact terminal part is elastically pushed to the peripheral face part of the electrode of the battery, the base body part is elastically pushed for the first time to the protrusion parts or side walls of the groove parts of the machine casing, thereby being supported (held).

Protrusion ends of the protrusion parts and protrusion ends of protrusive parts giving the groove parts are typically fitted to openings formed in another machine casing part (e.g., a train wheel bridge or a main plate) opposing in a thickness direction of the timepiece with respect to the machine casing part (e.g., the main plate or the wheel train bridge) in which the protrusion parts and the protrusive parts have been formed, thereby being strongly supported. By this, also in the thickness direction of the timepiece, it is possible to position the base body part from both sides under a state that an interstice necessary for an operation has been left.

An electronic timepiece of the invention possesses such a battery electrode terminal member as mentioned above.

In the electronic timepiece of the invention, desirably, an oscillator case body pushing part elastically pushed to a case body of an oscillator is extended from the other end of the base body part. In this case, the battery electrode terminal member can function also as an oscillator case body pushing means.

Further, in the electronic timepiece of the invention, desirably, a reset lever biasing spring part applying a biasing force from a non-reset position toward a reset position to a reset lever is extended from one end edge in a width direction of the base body part. In this case the battery electrode terminal member can function also as a reset means of the reset lever. Further, since the reset lever biasing spring part of a body separate from the reset lever extends in a direction practically perpendicular to the reset lever and can be engaged with a spring receiving part of the reset lever, even if a shape of the spring part is simplified, it becomes possible to certainly obtain a desired biasing force. Further, since the reset lever can be formed practically like a rigid body, it is easy to inexpensively and certainly obtain the reset lever operating stably.

Additionally, in the electronic timepiece of the invention desirably, a winding stem positioning engaging part, which is elastically engaged with a small diameter part adjoining a large diameter bead-like part of a winding stem and which is elastically deformed by the bead-like part on the occasion of putting in/out of the winding stem to thereby allow a transit of the bead-like part, is extended from one end edge in a width direction of the base body part. In this case, the battery electrode terminal member can position the winding stem and can function also as a winging stem positioning means giving a click feeling to the putting in/out of the winding stem.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

Next, one preferred implementation mode of the invention is explained on the basis of one preferred embodiment shown in the appended drawings.

Figure 1:
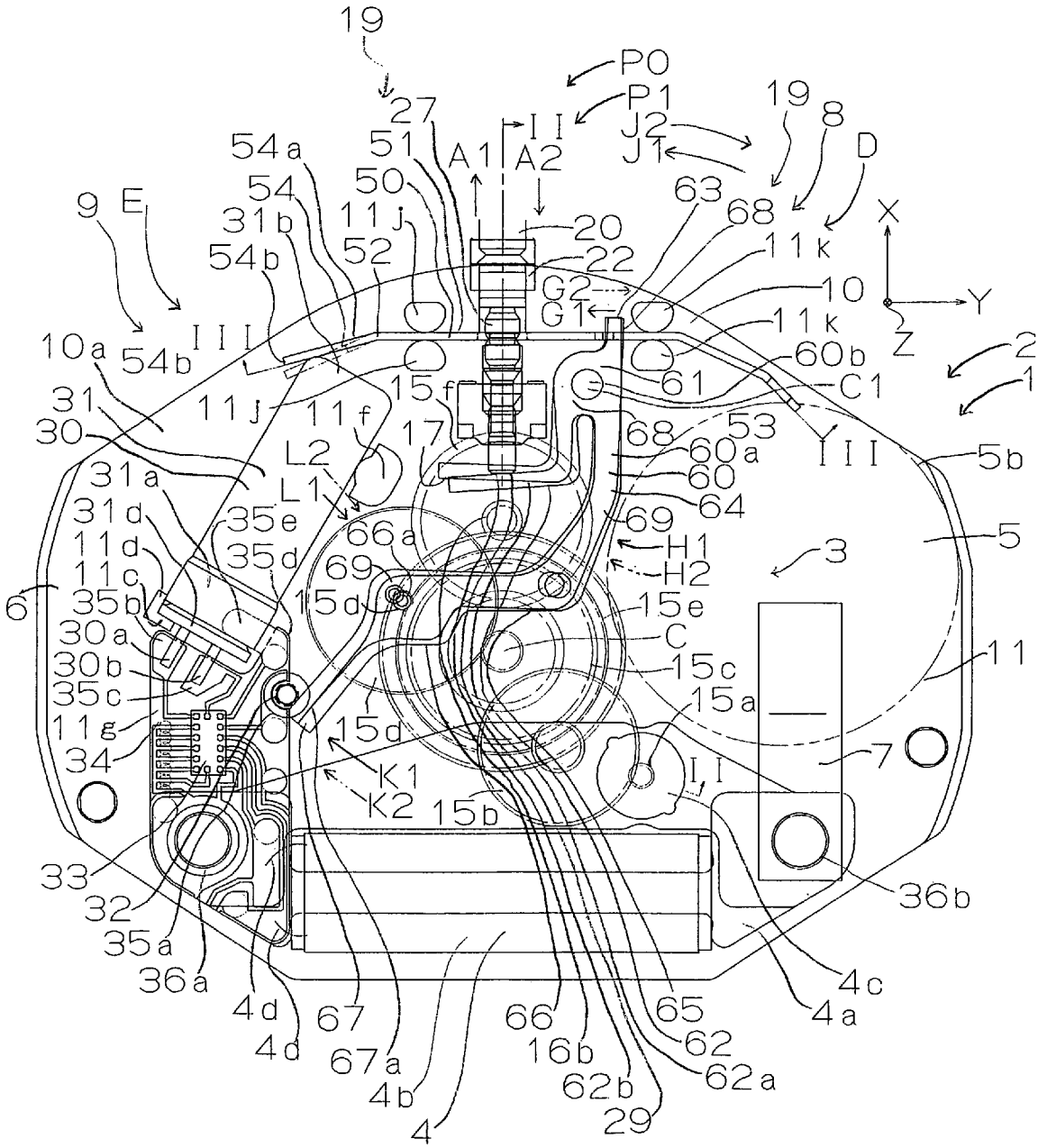
FIG. 1 is a plan explanatory view of a main body part (under a state that a train wheel bridge has been removed) of an electronic timepiece of one preferred embodiment, of the invention, possessing a plate spring structural body as a battery electrode terminal member of one preferred embodiment of the invention.
Figure 2:
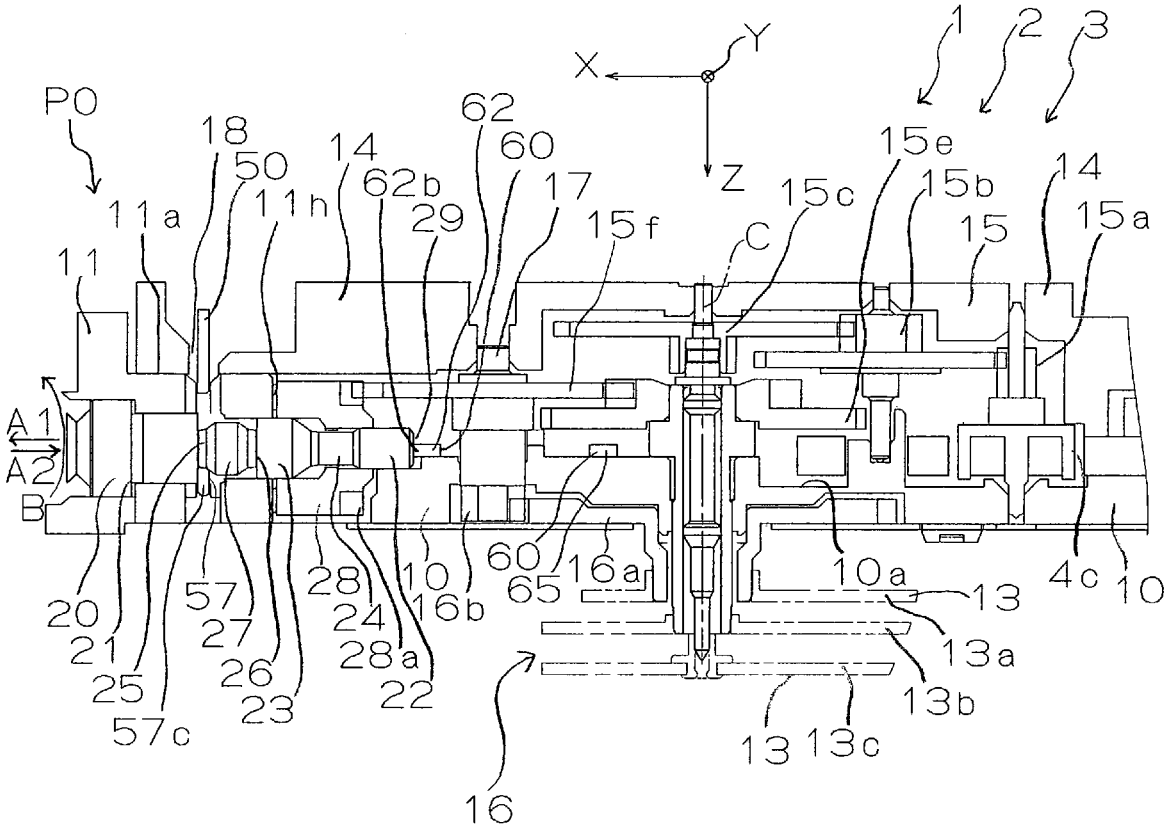
FIG. 2 is a sectional explanatory view along a II-II line of FIG. 1.

A timepiece main body 2 of an electronic timepiece 1 possesses a main plate 10 constituting a machine casing. Hereunder, for a simplification of the explanation, there is adopted a three-dimensional orthogonal coordinate system fixed to the main plate 10. Here, a pulling-out direction A1 (3 o'clock side) of a winding stem 20 is made an X direction, a right direction (12 o'clock side) in FIG. 1 is made a Y direction, and a direction deep in the drawing and perpendicular to the drawing is made a Z direction. The Z direction coincide with a side where a dial 12 (refer to FIG. 2) exists. Here, an XY plane is a face parallel to a main face of the timepiece main body 2, and the direction of a Z axis is a direction perpendicular to the main face of the timepiece main body 2. In FIG. 1 and FIG. 2, C is a rotation center axis of time display hand 13 (i.e., hour hand 13*a*, minute hand 13*b*, second hand 13*c*) connected to a train wheel mechanism 3 of the timepiece main body 2. Here, the timepiece main body 2 indicates a portion excluding an armor portion such as case from the timepiece 1.

The main plate 10 possesses irregularities and a surface shape, which are suitable for a disposition/support of various timepiece elements to be positioned to respective positions of a −Z side surface 10*a* of the main plate 10. The main plate 10 has a side wall 11 (FIG. 2) possessing a winding stem guiding hole 11*a* in a 3 o'clock side position, and possesses crystal oscillator case body (crystal can) receiving protrusion parts 11*f*, 11*d* protrusively provided in the −Z side surface 10*a*, a crystal oscillator case body (crystal can) end face receiving side wall part 11*c*, a flexible circuit board mounting protrusion part 11*g*, a battery accommodating concave part 11*b* whose one part of a peripheral wall has been defined by a clutch wheel receiving concave part 11*h* and the side wall 11, which have been formed in the surface 10*a*, and the like, and so forth. Incidentally, within the surface 10*a* of the main plate 10, in an approximately 5 o'clock direction of the hand when seen from the center axis C, there is additionally implanted a reset pin 32. A position of the reset pin 32 may be other position in dependence on dispositions and shapes of a circuit board 34 mentioned later and the like.

As shown in FIG. 2, the winding stem 20 penetrating through the winding stem guiding holes 11*a* of the main plate 10 possesses, in addition to a large diameter axle part 21 in a base end side, a prismatic engaging axle part 22 in a tip, a columnar medium diameter axle part 23 in an intermediate, a columnar small diameter axle part 24 between the axle parts 22, 23, and a bead-like part 27 whose both sides in A1, A2 directions have been defined by small diameter axle parts 25, 26, and is fitted to a clutch wheel 28. The clutch wheel 28 possessing a medium diameter hole part and an angular, tubular hole part is located in the clutch wheel receiving concave part 11*h*, and fitted to the winding stem 20 among the axle parts 22, 24, 23. In a case where the winding stem 20 exists in a 0th stage position (normal position) pushed in the A2 direction, the medium diameter hole part in the base end side and the angular, tubular hole part in a tip (deep) side of the clutch wheel 28 are rotatably fitted respectively to the medium diameter axle part 23 and the small diameter axle part 24 of the winding stem 20. On the other hand, in a case where the winding stem 20 exists in a 1st stage position (pulled-out position) pulled out by one stage in the A1 direction, the angular, tubular hole part of the clutch wheel 28 of the main plate 10 is engaged with the prismatic engaging axle part 22 in the tip of the winding stem 20, and the clutch wheel 28 is rotated in compliance with a rotation of the winding stem 20 in a B direction. The clutch wheel 28 is meshed with an eighth wheel gear 15*f* by a wheel gear part 28*a* in a tip.

As understood from FIG. 1 and FIG. 2, the train wheel mechanism 3 contains a front side train wheel 15 located between the main plate 10 and a portion of a train wheel bridge 14 located with a space being left in a −Z direction with respect to the main plate 10, and a back side train wheel 16 located in a +Z side of the main plate 10. The train wheel bridge 14 can be deemed to be one part of the machine casing similarly to the main pale 10. The front side train wheel 15 contains a sixth wheel & pinion 15*a*, a fifth wheel & pinion 15*b*, a second wheel & pinion (second wheel) 15*c*, a third wheel & pinion 15*d*, a center wheel & pinion (minute wheel) 15*e* and the eighth wheel gear 15*f*, and the back side train wheel 16 contains an hour wheel (hour wheel) 16*a* and an eighth pinion 16*b*. An axle or case band of an eighth wheel & pinion (minute wheel) 17 extends while penetrating through the main plate 10 in the Z direction, the eighth wheel gear 15*f* is provided in a side of the front train wheel 15, and the eighth pinion 16*b* is provided in a side of the back side train wheel 16. Within an axle of the third wheel & pinion 15*d*, an axle part in a side adjoining the main plate 10 is fitted to a bearing hole 66*a* of a reset lever 60 mentioned later.

In FIG. 1, within the surface 10*a* of the main plate 10, in a position in a side opposite to the winding stem 20, i.e., 9 o'clock side, there is disposed a motor 4 elongated in the Y direction. In FIG. 1, in a right side of the winding stem 20 and the motor 4, a button type battery 5 is disposed in a battery accommodating concave part 11*b* whose one part of the peripheral wall has been defined. Further, in FIG. 1, in a left side of the winding stem 20 and the motor 4, there is disposed a circuit block 6 containing the flexible circuit board 34 mounted with an IC (Integrated Circuit) 33 for the timepiece, and a crystal oscillator 30. In compliance with a desire, circuit components other than the IC 33 are also mounted to the board 34.

The motor 4 contains a stator 4*a*, a coil block 4*b* and a rotor 4*c*, and a rotor pinion constituting the sixth wheel & pinion 15*a* is formed in an axle of the rotor 4*c*. The coil block 4*b* of the motor 4 is electrically connected to the flexible circuit board 34 by extension parts 4*d* of a winding.

36*a*, 36*b* are connection parts for mechanically, monolithically connecting the stator 4*a* and the coil block 4*b*. In a place of the connection part 36*a*, the circuit board 34 is fixed to the motor 4 and, in a place of the connection part 36*b*, a battery minus terminal 7 is fixed to the motor 4. The connection parts 36*a*, 36*b* possess in their center an opening, a protrusion protrusively provided from the main plate 10 is fitted and thermally caulked to the opening, and the whole of the motor 4, the circuit board 34 and the like are fixed to the main plate 10. The battery minus terminal 7 extends in a +Z side of the battery 5 along the surface 10*a* of the main plate 10, and contacts with a negative electrode 5*a* (FIG. 3) in an end face of the battery 5 mounted on the surface 10*a* of the main plate 10. The battery minus terminal 7 is electrically connected to the circuit board 34 through the motor 4 (for example, a core insulated to windings of the stator member 4*a* and the coil block 4*b*, and the like) and gives a minus electric potential of the battery 5 to the circuit board 34. That is, a conductive portion itself of a component of the motor 4 cooperates with the battery minus terminal 7, thereby becoming an electric supply line in a minus side of an electric source.

A −Z side end part in the axle part of the rotor 4*c* of the motor 4 is rotatably supported in the train wheel bridge 14. The large diameter coil block 4*b* of the motor 4 protrudes in a −Z direction, and may be fitted loosely to a corresponding notch or opening (not shown in the drawing) of the train wheel bridge 14, or pushed by the train wheel bridge 14. Similarly, also the battery 5 whose height is high in the −Z direction is fitted to a corresponding battery attaching/detaching opening (not shown in the drawing) of the train wheel 14. In a case where a use in a range of life of the battery 5 is presupposed, there may be adapted such that the battery 5 is pushed by the train wheel bridge 14.

Within a +Z side surface of the flexible circuit board 34 of the circuit block 6, in a center-side side edge of the timepiece main body 2, there is formed a reset pin connecting conductive pad part 35*a* and, when the flexible circuit board 34 has been mounted on the main plate protrusion part 11*g* of a plane shape practically the same as the board 34 in an example shown in the drawing, the conductive pad part 35*a* just butts against a −Z side end face (top face) of the reset pin 32. Incidentally, as to the protrusion part 11*g*, so long as it can support the flexible circuit board 34 with a desired stability, of course its shape may differ from the flexible circuit board 34. Incidentally, under a state that the train wheel bridge 14 has been attached, the train wheel bridge 14 pushes the conductive pad part 35*a* of the circuit board 34 to the top face of the reset pin 32. However, an electrical connection between the reset pin 32 and the circuit board 34 may be realized by a different form.

In the circuit board 34, there are additionally formed conductive patterns 35*b*, 35*c*, 35*d*, and a connection terminal piece part 35*e* is attached to the conductive pattern 35*d*. The conductive pattern 35*d* is connected to an electric supplying terminal of an electric source voltage (electric potential) Vdd of the IC 33 for the timepiece, and the conductive patterns 35*b*, 35*c* are connected to terminals of the crystal oscillator 30. One pair of connection pins or connection terminal parts 30*a*, 30*b* of the crystal oscillator 30 are electrically connected and fixed to the conductive patterns 35*b*, 35*c* by soldering. The connection terminal piece part 35*e* electrically connected in its base end to the conductive pattern 35*d* extends along the surface 10*a* of the main plate 10, and contacts with a +Z side portion in a peripheral face of a conductive can, i.e., a base end part 31*a* of a crystal can 31, as a case body of the crystal oscillator 30 mounted on the surface 10*a* of the main plate 10. Incidentally, a basal side end face 31*d* of the crystal oscillator main body 31 butts against the crystal oscillator case body (crystal can) end face receiving side wall part (side face part) 11*c* existing near the flexible circuit board mounting protrusion part 11*g* of the main plate 10. The wall part 11*c* may be one part of the protrusion part 11*g*.

Figure 3:
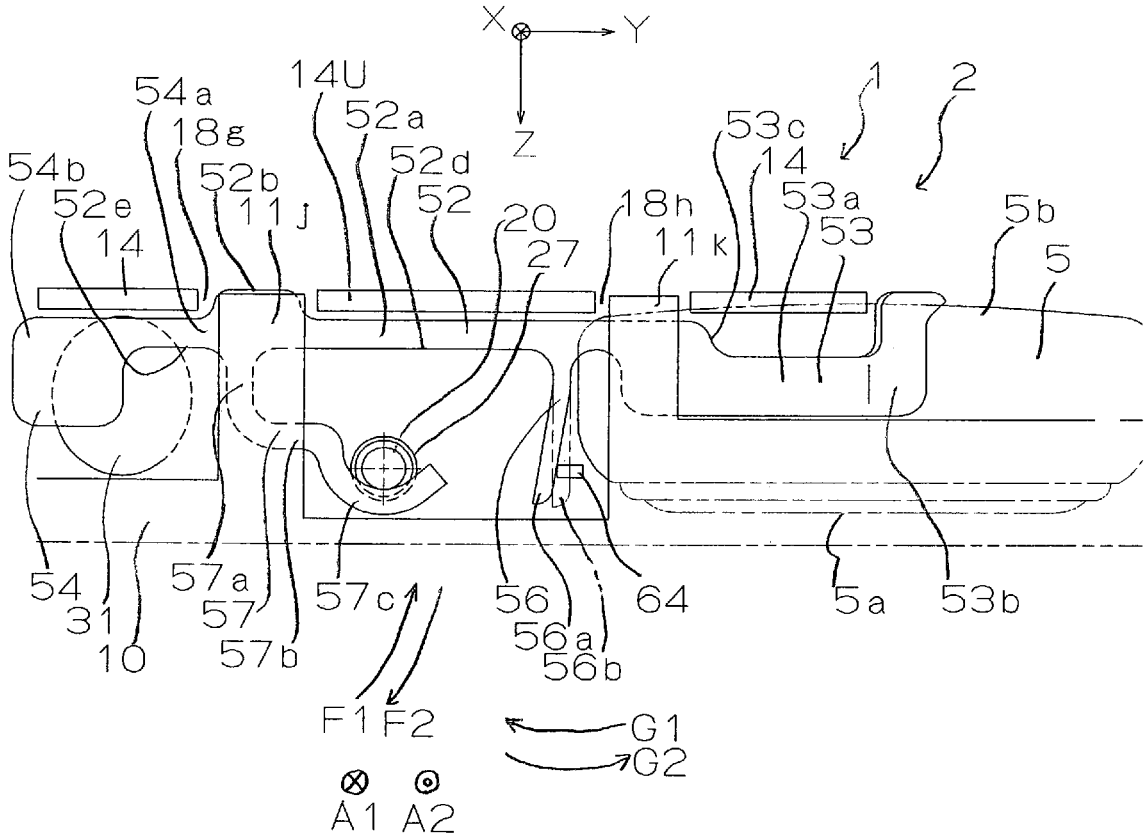
FIG. 3 is a sectional explanatory view along a III-III line of FIG. 1, showing a disposition of the plate spring structural body.
Figure 4:
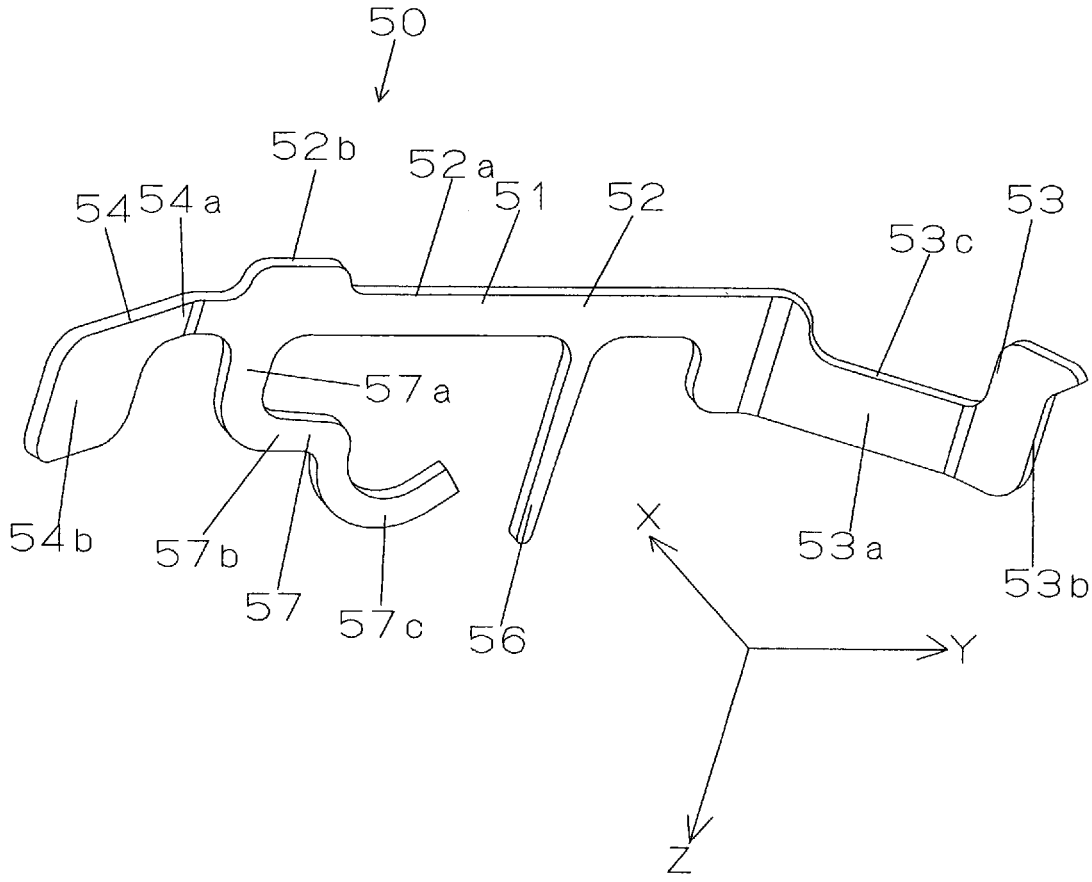
FIG. 4 is a perspective explanatory view of the plate spring structural body of FIG. 1.

In the main plate 10, there is formed an engaging part 19 and, in the engaging part 19, there is locked a plate spring structural body 50 acting as a battery plus terminal as a battery electrode terminal member. As shown in FIG. 3 and FIG. 4 in addition to FIG. 1 and FIG. 2, a main face or surface of the plate spring structural body 50 is perpendicular to the XY plane. That is, a normal line to the main face of each part of the plate spring structural body 50 is located in a face parallel to the XY plane irrespective of a direction of the main face.

As understood from FIG. 1, FIG. 3 and FIG. 4, the plate spring structural body 50 has a main body part 51 extending approximately in the Y direction along the timepiece main body 2. The plate spring main body part 51 possesses a center part 52 extending in the Y direction, a battery plus electrode contact terminal part 53, as a battery electrode contact terminal part, which extends to a −X side in a slanting direction at an obtuse angle with respect to the center part 52 from a +Y direction end part of the center part 52 and whose tip is elastically pressure-contacted to a peripheral face making a plus electrode 5*b* of the battery 5, and a crystal can contact terminal part 54, as an oscillator case body pushing part, which extends to the −X side in the slanting direction at the obtuse angle with respect to the center part 52 from a −Y direction end part of the center part 52 and whose tip is elastically pressure-contacted to a side edge 31*c* of a tip part 31*b* of the crystal can 31 as a crystal oscillator case body. In the center part 52, there is formed a protrusion part 52*b*. Here, a battery electrode terminal member comprises the base body part 51 and the battery plus electrode contact terminal part 53. The plate spring structural body 50 comprises a stainless alloy plate whose thickness is about 0.15-0.2 mm for instance. Of course, the thickness and the material may differ.

The battery plus electrode contact terminal part 53 contains a slanting arm part 53*a* extending to the −X side in the slanting direction at the obtuse angle with respect to the center part 52 from the +Y direction end part of the center part 52, and a battery plus electrode contact part 53*b* extending slantingly to the −X side at a more obtuse angle from a tip of the slanting arm part 53*a*, and is pressure-contacted to the battery plus electrode 5*b* in a tip part of the battery plus electrode contact part 53*b*. A bent angle of the contact part 53*b* with respect to the center part 52 is 90 degrees or less as a whole. In this example, the center part 52 becomes widened in the Z direction in the vicinity of a +Y direction end part, and the battery plus electrode contact terminal part 53 is partially notched in its side edge 53*c* in a −Z side. Incidentally, by the fact that the contact part 53*b* in the tip of the battery plus electrode contact terminal part 53 stands up in a −Z direction and additionally possesses a tip part 53*d* straight extending forward from the standing-up end part (FIG. 3), a wide contacting region is ensured with respect to the battery plus electrode 5*b*.

The crystal can contact terminal part 54 possesses a narrow arm part 54*a* and a crystal can contact part 54*b* widely formed in a tip part of the arm part 54*a* in the Z direction, and is pressure-contacted to the side edge 31*c* of the tip part 31*b* of the crystal can 31 by the contact part 54*b*.

Accordingly, by the fact that the plate spring structural body 50 contacts with the plus electrode 5*b* of the battery 5 by the battery plus electrode contact terminal part 53 and contacts with the crystal can 31 by the crystal can contact terminal part 54, it functions as a battery plus terminal for directly giving a voltage (electric potential) of the plus electrode 5*b* of the battery 5 to an electric source terminal of the IC 33 through the connection terminal piece part 35*e* and the conductive pattern 35*d* as the electric supply line. An electric supply mechanism 9 comprises the plate spring structural body 50 and the connection terminal piece part 35*e*.

Incidentally, since the plate spring structural body 50 having such structure and shape as mentioned above is formed by being bent at 90 degrees or less and in one direction as a whole with respect to the center part 52, a formation of bending die therefor and a bending operation can be performed in a cost and a time, which are lowest limits.

In this case, since the crystal can 31 itself is utilized as a conductive path, practically it is possible to shorten a length of the plate spring structural body 50 by for a length of the crystal can 31 in comparison with a case where the positive electrode 5*b* of the battery 5 and the electric source terminal 35*d* of the circuit board 34 are directly connected by the battery plus terminal. Incidentally, if it is attempted to extend the battery plus terminal to a place of the train wheel mechanism part 3, not only a degree of freedom in a layout of various components decreases but also it becomes necessary to make the battery plus terminal into a complicated plane shape and a complicated bent shape, whereas in this case a comparatively simple shape suffices for the plate spring structural body 50.

As shown in FIG. 1 and FIG. 3, the plate spring structural body 50 is fitted between opposed protrusion part pair 11*j*, 11*j* and between opposed protrusion part pair 11*k*, 11*k*, which constitute the engaging part 19 of the main plate 10 in the center part 52. The opposed protrusion part pairs 11*j*, 11*j* and 11*k*, 11*k* substantially line-contact respectively with portions interposed between them within the center part 52 of the plate spring structural body 50, thereby supporting the portions. The protrusion part pairs 11*j*, 11*j* and 11*k*, 11*k* are formed monolithically with a base material of the main plate 10. However, if desired, its one part or whole part may be formed by a pin implanted in a main body of the main plate 10. Depending on a case, one protrusion part pair between the protrusion part pairs 11*j*, 11*j* and 11*k*, 11*k* may not exist. However, in that case, typically there is selected a position near the winding stem 20. Incidentally, in a case of this example, the protrusion part pair 11*j*, 11*j* regulate an X direction displacement of arm parts 57*a*, 57*b* of a winding stem positioning spring part 57 mentioned later, thereby accomplishing also a role ensuring an action for positioning the spring part 57.

Incidentally, in the train wheel bridge 14, there are formed opening parts 18*g*, 18*h*, and the protrusion part 52*b* of the plate spring structural body 50 and tip parts of the protrusion part pair 11*j*, 11*j* of the main plate 10 are inserted into and fitted to the opening part 18*g*. On the other hand, tip parts of the protrusion part pair 11*k*, 11*k* nipping the plate spring structural body 50 between them are inserted into and fitted to the opening part 18*h*. By this, in the thickness direction Z of the timepiece, the base body part can be positioned from both sides under a state that an interstice necessary for an operation is left. Further, if desired, it becomes also possible to strongly and stably hold portions located between the protrusion part pair 11*j*, 11*j* and between the protrusion part pair 11*k*, 11*k* within the plate spring structural body 50.

Figure 5:
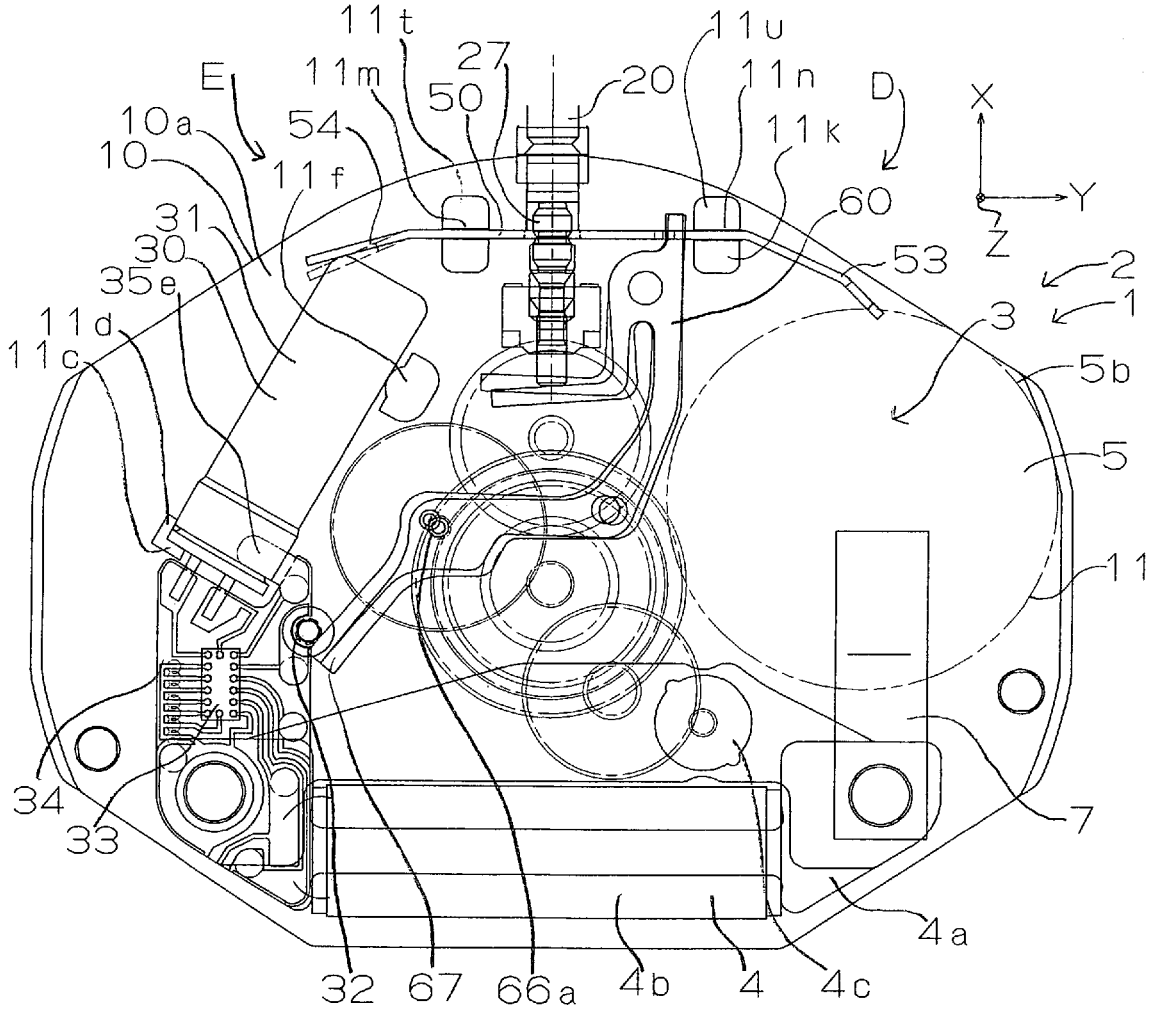
FIG. 5 is a plan explanatory view, similar to FIG. 1, about one modified example of the electronic timepiece.

Incidentally, as shown in FIG. 5, as the engaging part 19 it may be protrusion parts 11*t*, 11*u* possessing grooves 11*m*, 11*n* between them. In this case, the plate spring structural body 50 is inserted into the grooves 11*m*, 11*n* of the protrusion parts 11*t*, 11*u* constituting the engaging part 19 of the main plate 10 in the center part 52, and held while face-contacting with side walls of the grooves 11*m*, 11*n* of the protrusion parts 11*t*, 11*u*. However, in that case, typically an adjacent position of the winding stem 20 is selected.

Figure 6:
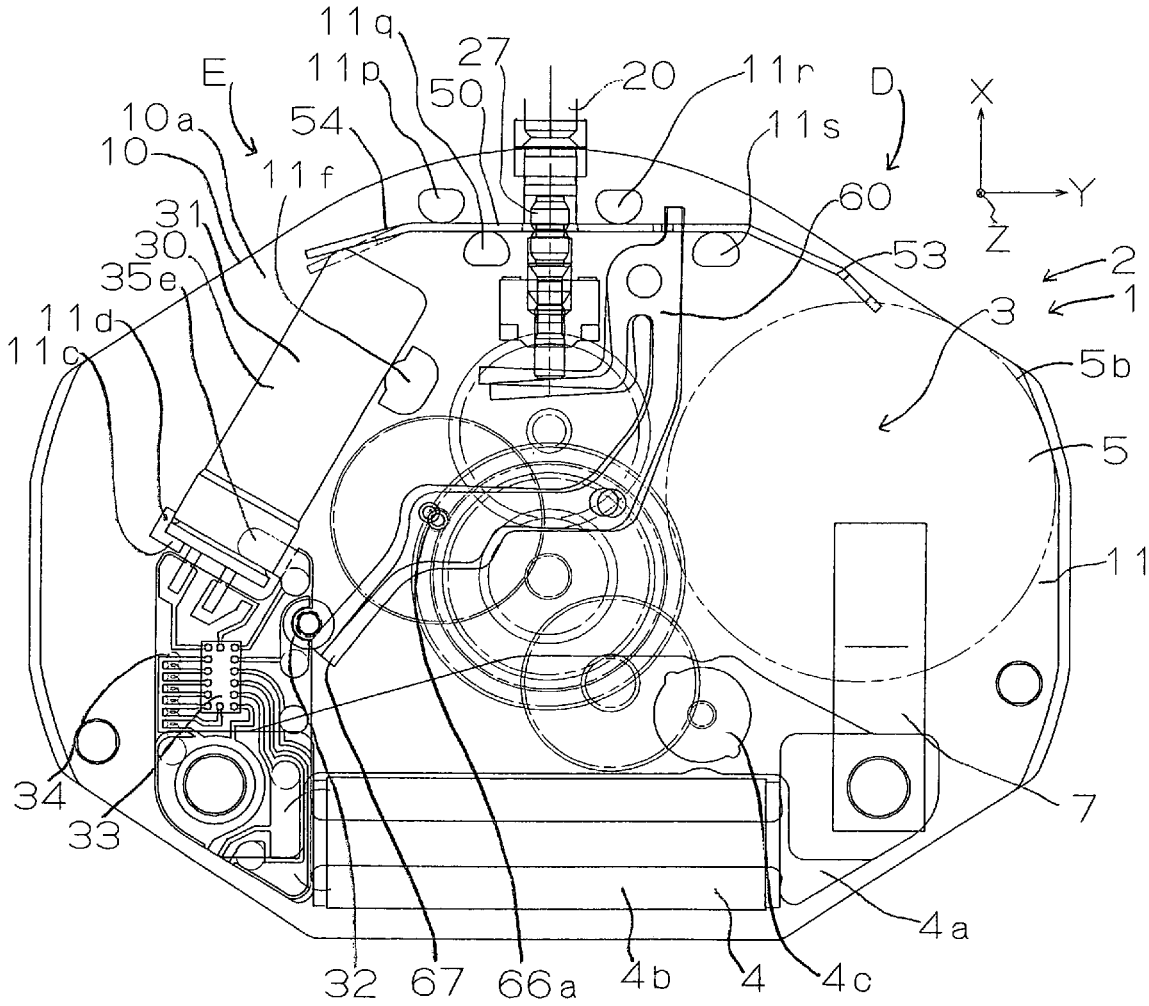
FIG. 6 is a plan explanatory view, similar to FIG. 1, about one other modified example of the electronic timepiece.

Further, as shown in FIG. 6, as the engaging part, it may be adapted such that, by zigzag forming plural protrusion parts 11*p*, 11*q*, 11*r*, 11*s* and substantially, linearly inserting one part portion (,e.g., the center portion 52) of the plate spring structural body 50 among the protrusion parts 11*p*, 11*q*, 11*r*, 11*s* so as to thread among the protrusion parts 11*p*, 11*q*, 11*r*, 11*s*, it is supported by the protrusion parts 11*p*, 11*q*, 11*r*, 11*s*. Also in this case, it may be adapted such that it is supported by fitting tip parts of the protrusion parts 11*p*, 11*q*, 11*r*, 11*s* to opening parts of the train wheel bridge 14. Also in this case, positions and the number of the protrusion parts zigzag disposed may differ.

In the above, although it has been explained about an example in which the engaging part 19 is formed in the main plate, the engaging part may be formed in the train wheel bridge 14 instead of being formed in the main plate 10 and, further, one part of the engaging part 19 may be formed in the main plate and remaining one part may be formed in the train wheel bridge 14.

The plate spring structural body 50 has additionally a reset lever biasing spring part 56 protruding from a side edge part in the +Z side, and a winding stem engaging spring part 57. The winding stem engaging spring part 57 contains the basal side arm part 57*a* extending in the +Z direction from a base body part 51, a tip side arm part 57*b* extending in the +Y direction from an extension end of the basal side arm part 57*a*, and an arc-like engaging part 57*c* extended from a tip of the arm part 57*b*, and is elastically engaged with the small diameter part 25 or 26 in the vicinity of the bead-like part 27 of the winding stem 20 by the arc-like engaging part 57*c*.

Since this plate spring structural body 50 extends in the Y direction as a whole and consists of a plate spring possessing a width in the Z direction, an area occupying in the X-Y plane can be suppresses to the lowest limit. Further, since the plate spring structural body 50 can be held only by being inserted between the protrusion part pairs 11*j*, 11*j* and 11*k*, 11*k*, into the groove parts 11*m*, 11*n*, between the protrusion parts 11*p*, 11*q*, 11*r*, 11*s* zigzag disposed, or the like and does not require a fixing structure such as screw fixing and caulking, a space required for the holding can be suppresses to the lowest limit as well.

Incidentally, in the above, the center part 52 of the base body part 51 of the plate spring structural body 50 may be directly held between the protrusion part pairs 11*j*, 11*j* and 11*k*, 11*k*, in the groove parts 11*m*, 11*n* and between the protrusion parts 11*p*, 11*q*, 11*r*, 11*s* zigzag disposed, instead of it, there may be adapted such that—by the fact that under the state that the center part 52 of the base body part 51 of the plate spring structural body 50 has been inserted between the protrusion part pairs 11*j*, 11*j* and 11*k*, 11*k*, into the groove parts 11*m*, 11*n*, between the protrusion parts 11*p*, 11*q*, 11*r*, 11*s* zigzag disposed or the like, (the center part 52 of the base body part 51 of) the plate spring structural body 50 is under a loosely fitting state, and by butting the plate-spring-like terminal parts 53, 54 in both ends of the plate spring structural body 50 against both of or one of the peripheral face of the positive electrode 5*b* of the battery 5 and the side edge of the side edge tip 31*b* of the case body. 31 of the crystal oscillator 30 (i.e., a peripheral face of a positive electrode 5*b* of the battery 5 or a side edge of a side edge tip 31*b* of the case body 31 of the crystal oscillator 30)—the center part 52 of the base body part 51 of the plate spring structural body 50 is pushed for the first time to between the protrusion part pairs 11*j*, 11*j* and 11*k*, 11*k*, side walls of the groove parts 11*m*, 11*n*, the protrusion parts 11*p*, 11*q*, 11*r*, 11*s* zigzag disposed or the like, thereby being held.

As understood from FIG. 1 and FIG. 3, the plate spring structural body 50 is engaged with the engaging part 19 of the main plate 10 in the center part 52 and supported by the main plate 10, the battery plus electrode contact terminal part 53 located in a +Y direction end part is elastically pressure-contacted in a D direction to the peripheral face of the positive electrode 5*b* of the battery 5, and the crystal can contact terminal part 54 located in a −Y direction end part is elastically pressure-contacted in an E direction to the side edge 31*c* of the tip part 31*b* of the crystal can 31 supported by the crystal oscillator case body receiving protrusion parts 11*f*, 11*d* and the crystal oscillator case body (crystal can) end face receiving side wall part (side face part) 11*c* of the main plate 10. Accordingly, since the plate spring structural body 50 can elastically press down the battery 5 and the crystal oscillator 30 while being supported by the engaging part 19 of the main plate 10, both of the battery 5 and the crystal oscillator 30, whose size is large in comparison with other component and whose mounting stability is liable to become bad, can be simultaneously, stably positioned and fixed. Further, since the plate spring structural body 50 contacts in its one end with the battery 5 under a large contact pressure and is contacting in its the other end with the crystal can 31 of the crystal oscillator 30 under the large contact pressure, it is possible to certainly transmit a plus electric potential of the battery 5 to the crystal can 31. Moreover, since the crystal can 31 is connected to an electric source voltage supply terminal of the IC 33 of the circuit block 6 through the contact terminal piece part 35*e* and the conductive pattern 35*d*, it is possible to directly utilize the case body of the crystal oscillator 30, i.e., the crystal can 31, for the supply of the electric source voltage. Since the crystal oscillator case body part or the crystal can 31 occupies a large volume or area in the main body part 2 of the electronic timepiece 1, a length of the battery plus terminal can be suppressed to the lowest limit.

Further, in the arc-like engaging part 57*c* of the winding stem engaging spring part 57, since the spring structural body 50 is engaged with the small diameter parts 25, 26 in both sides of the bead-like part 27 of the winding stem 20 and is applying an elastic force in an F1 direction to the winding stem 20, it is possible to stably, elastically hold the winding stem 20 elastically engaged with the spring part 57 in the small diameter parts 25 and 26 without position-deviating in the A1, A2 directions, thereby positioning the winding stem 20. Further, since the engagement of the spring part 57 with the small diameter parts 25 and 26 is an elastic engagement, in a case where the winding stem 20 is pulled out, e.g., in the A1 direction, when the winding stem 20 exists in the 0 stage position and the arc-like engaging part 57*c* of the spring part 57 is engaged with the small diameter part 25 of the winding stem 20, it follows that the bead-like part 27 is moved in the A1 direction by being elastically deformed such that the arc-like engaging part 57*c* of the spring part 57 is pushed down in an F2 direction by the bead-like part 27 whose diameter is larger than the small diameter part 25. If the bead-like part 27 passes through the spring part 57 in the A1 direction, the arc-like engaging part 57*c* of the spring part 57 is deformed again in the F1 direction by an elastic restoring force, and fits to the small diameter part 26. By this, when pulling out the winding-stem 20 in the A1 direction, the spring part 57 of the spring structural body 50 cooperates with the bead-like part 27, thereby being capable of giving the click feeling. Also when pushing the winding stem 20 in the A2 direction from the winding stem 1st stage to the winding stem 0th stage, since it follows that, after the engaging part 57*c* of the spring part 57 has been deformed so as to allow a transit of a maximum diameter part of the bead-like part 27 from the small diameter part 26, it fits to the small diameter part 25, a similar click feeling is obtained.

Incidentally, on the occasion of such a support of the spring part 57 as mentioned above, since it follows that the spring structural body 50 is not only held by the engaging part 19 of the main plate 10 but also supported through the both end spring part 53, 54 by the battery 5 and the crystal can 31 as a reaction of elastically pushing the battery 5 and the crystal can 31 in the both end parts 53, 54, the support of the winding stem 20 can be stabilized under a stably held state.

Incidentally, if desired, by forming a protrusion part protruding in the −Z direction in the surface 10*a* of the main plate 10 or providing a support protrusion part in a bottom part of the engaging part 19 mentioned above, there may be adapted so as to support a side edge part 52*d* (FIG. 3) in the +Z side of the center part 52 of the spring structural body 50 by the protrusion part. In that case, since it is possible to certainly prohibit a displacement of the center part 52 to the +Z direction, the spring part 57 can certainly give the click feeling.

The electronic timepiece 1 additionally possesses the reset lever 60 as a reset lever main body part. In this example, the reset lever 60 possesses a plate-like part 60*a* consisting of a punched sheet metal body of a shape like a sea horse as a whole, and an axle part 60*b* for rotatably supporting the plate-like part 60*a* with respect to the main plate 10 about a rotation center axis C1 in a center part. The axle part 60*b* may be rotatably supported in a bearing hole of the main plate 10, the plate-like part 60*a* may be rotatable with respect to the axle part 60*b*.

The reset lever plate-like part 60*a* has an L-shaped arm part 62 extending to a place of a tip of the winding stem 20 from a center boss part or stout part 61 spreading in a region containing the rotation center axis C1, a spring receiving part or engaging protrusion part 63 protruding in the X direction from the boss part 61 and engaging with the spring part 56, a vertical direction arm part 64 extending approximately in the −X direction from the boss part 61, a lateral direction arm part 65 extending approximately in the −Y direction from an extension end, of the vertical direction arm part 64, extending slightly slantingly, a third wheel & pinion bearing stout part or boss part 66 formed in a tip of the arm part 65, and a reset terminal part 67 slantingly extending from the boss part 66 to a place of the reset pin 32. In the above, the boss part 61, the L-shaped arm part 62 and the engaging protrusion part 63 constitute an input side lever part 68, and the arm parts 64, 65, 67 and the boss part 66 constitute an output side lever part 69. Further, in the above, a reset lever unit 8 comprises the reset lever 60, and the spring part 56 of the plate spring structural body 50.

In a case where the winding stem 20 exists in a winding stem 0th stage P0 pushed in the A2 direction, a side edge 62*b* of a position detecting arm part 62*a* in a tip side of the L-shaped arm part 62 of the reset lever 60 is pushed in the A2 direction from a tip face 29 of the winding stem 20. In order to avoid an excessive A1 direction reaction force from acting on the winding stem 20, although typically the L-shaped arm part 62 can somewhat deflect, it has a rigidity far higher than the reset lever biasing spring part 56 of the plate spring structural body 50 and can be deemed to be a rigid body so long as being compared with the spring part 56.

In the case where the winding stem 20 exists in the winding stem 0th stage P0 pushed in the A2 direction, the spring receiving part or engaging protrusion part 63 of the reset lever 60 is pushed in the −Y direction to a side edge 56*b* in the +Y side of a tip part 56*a* of the reset lever biasing spring part 56 of the plate spring structural body 50, thereby elastically deforming the biasing spring part 56 so as to shift the tip part 56*a* of the reset lever biasing spring part 56 in a G1 direction (solid lines in FIG. 3).

Accordingly, in the case where the winding stem 20 exists in the winding stem 0th stage, the reset lever 60 takes a non-reset position H1 shown by solid lines in FIG. 1. That is, in the case where the winding stem 20 exists in the winding stem 0th stage, the input side lever part 68 is rotation-displaced in a J1 direction under an action of a pushing force in the A2 direction by the tip face 29 of the winding stem 20, thereby pushing the spring part 56 of the plate spring structural body 50 to the G1 direction. The output side lever part 69 of the reset lever 60 is also rotation-displaced in the J1 direction, and the reset terminal part 67 takes a non-reset position K1 where a side edge 67*a* of its tip has separated from the reset pin 32. Incidentally, in the case where the reset lever 60 takes the non-reset position H1, a third wheel & pinion support bearing part 66*a* takes an engaging position L1, and a third wheel & pinion 15*d* meshes with the center wheel & pinion 15*e*, thereby transmitting a rotation of the second wheel & pinion 15*c* to the center wheel & pinion 15*e*.

On the other hand, if the winding stem 20 is pulled out in the A1 direction and takes a winding stem 1st stage position P1, the tip face 29 of the winding stem 20 moves in the A1 direction, and separates from the side edge 62*b* of the position detecting arm part 62*a* of the L-shaped arm part 62 of the reset lever 60. Accompanying a release of rotation displacement force in the J1 direction with respect to the input side lever part 68, the input side lever part 68 is rotated in a J2 direction about the center axis C1 by the elastic restoring force, in a G2 direction, that the spring part 56 of the plate spring structural body 50 applies to the protrusion part 63. Accordingly, the output side lever part 69 is also rotation-displaced in the J2 direction, and the reset terminal part 67 is pushed to the reset pin 32 in the side edge part 67*a* of the tip. That is, if the winding stem 20 is pulled out in the A1 direction and takes the winding stem 1st stage position P1, the reset lever 60 takes a reset position H2 shown by imaginary lines in FIG. 1, and is set to reset position K2 where the reset terminal part 67 buts against the reset pin 32. As a result, a supply of driving signal from the circuit block 6 to the motor 4 is stopped, a rotation of the motor 4 is stopped, and a rotation of the second hand 13*c* is stopped. Incidentally, if the reset lever 60 takes the reset position K2, the third wheel & pinion support bearing part 66*a* takes a non-engaging position L2, a mesh between the third wheel & pinion 15*d* and the center wheel & pinion 15*e* is released, and a rotation of the center wheel & pinion (minute wheel) 15*e* becomes not transmitted to the second wheel & pinion (second wheel) 15*c*. As a result, although a rotation of the winding stem 20 for a hand rotation is transmitted from the clutch wheel 28 to the hour wheel 16*a* and the center wheel & pinion (minute wheel) 15*e* through the minute wheel 17, since the rotation is not transmitted to the second wheel & pinion (second wheel) 15*c*, hand settings of the minute hand 13*b* and the hour hand 13*a* can be performed under a state that the second hand 13*c* has been stopped. Incidentally, instead of adapting such that the mesh between the third wheel & pinion 15*d* and the center wheel & pinion 15*e* is released by a displacement by the third wheel & pinion support bearing part 66*a*, it may be adapted such that a mesh between the third wheel & pinion 15*d* and the second wheel & pinion 15*c* is released.

What is claimed is:

1. An electronic timepiece, comprising: a timepiece main body having a main face; a battery electrode terminal member having a spring plate structure made of a plurality of parts and mounted to and supported by the timepiece main body so that a normal line extending from a main face of each of the plurality of parts is parallel to the main face of the timepiece main body, the plurality of parts comprising a base body part and a battery electrode contact terminal part extending from one end of the base body part for elastical pressure contact with a peripheral face part of an electrode of a battery; and an oscillator having a case body; wherein the plurality of parts further comprises an oscillator case body part extending from an end of the base body part opposite to the end thereof from which the battery electrode contact terminal part extends, the oscillator case body part being disposed in elastical pressure contact with the case body of the oscillator.

2. An electrode case according to claim 1; wherein the base body part is configured to be supported while being nipped between protrusion parts or in groove parts of the timepiece main body.

3. An electronic timepiece according to claim 1; further comprising a reset lever; and wherein the plurality of parts further comprises a reset lever biasing spring part for applying to the reset lever a biasing force from a non-reset position toward a reset position, the reset lever biasing spring part extending from one end edge of the base body part in a width direction thereof.

4. An electronic timepiece according to claim 1; further comprising a winding stem mounted to undergo in and out movement relative to the timepiece main body, the winding stem having a large diameter bead-shaped part; and wherein the plurality of parts further comprises a winding stem positioning and engaging part extending from one end edge of the base body part in a width direction thereof, the winding stem positioning and engaging part being elastically engaged with a small diameter part adjoining the large diameter bead-shaped part of the winding stem for permitting movement of the bead-shaped part by being elastically deformed by the bead-shaped part during in and out movement of the winding stem.

5. An electronic timepiece according to claim 1; wherein the spring plate structure is made of metal.

6. An electronic timepiece according to claim 1; wherein the battery electrode contact terminal part extends at an obtuse angle relative to a center part of the base body part.

7. An electronic timepiece comprising:

a movement for counting time;

a power source for driving the movement;

an oscillator having a case body;

a main body including a case that houses the movement, the power source and the oscillator;

a winding stem mounted to undergo in and out movement relative to the timepiece main body; and a spring plate structure made of a plurality of parts and configured to be mounted to and supported by the case so that a normal line extending from a main face of each of the plurality of parts is parallel to a main face of the main body, the plurality of parts comprising a base body part, a contact terminal part extending from one end of the base body part for elastical pressure contact with a peripheral surface part of an electrode of the power source, a winding stem positioning and engaging part extending from one edge of the base body part in a width direction thereof for engagement with the winding stem, and an oscillator case body part for elastical pressure contact with the case body of the oscillator, the oscillator case body part extending from an end of the base body part opposite to the end thereof from which the contact terminal part extends.

8. An electronic timepiece according to claim 7; wherein the spring plate structure is made of metal.

9. An electronic timepiece according to claim 7; wherein the contact terminal part extends at an obtuse angle relative to a center part of the base body part.

* * * * *